United States Patent [19]

Ruseff et al.

[11] 4,381,646

[45] May 3, 1983

[54] TORQUE AND HIGH PRESSURE LIMITING CONTROL FOR VARIABLE DISPLACEMENT PUMPS

[75] Inventors: Walter Z. Ruseff, New Lenox; James E. Schimpf, Joliet, both of Ill.

[73] Assignee: Caterpillar Tractor Co., Peoria, Ill.

[21] Appl. No.: 261,101

[22] PCT Filed: Sep. 12, 1980

[86] PCT No.: PCT/US80/01195

§ 371 Date: Sep. 12, 1980

§ 102(e) Date: Sep. 12, 1980

[87] PCT Pub. No.: WO82/01047

PCT Pub. Date: Apr. 1, 1982

[51] Int. Cl.[3] ..... F16D 31/02; F04B 49/08

[52] U.S. Cl. ..... 60/452; 417/222

[58] Field of Search ..... 60/445–452, 60/486; 417/212, 216–222

[56] References Cited

U.S. PATENT DOCUMENTS

| | | | |
|---|---|---|---|
| 3,918,259 | 11/1975 | Habiger et al. | 60/445 |
| 3,941,514 | 3/1976 | Louis et al. | 417/216 |
| 3,999,892 | 12/1976 | Hein | 60/428 X |
| 4,034,564 | 7/1977 | Johnson et al. | 60/445 |
| 4,116,587 | 9/1978 | Liesener | 60/452 X |
| 4,129,987 | 12/1978 | Blume | 60/445 |

OTHER PUBLICATIONS

"Pump Controls That Save Energy", by H. Sculthorpe, *Machine Design,* Apr. 21, 1977, pp. 255–259.

"The Search for Credible Design Data", by A. Barrett, *Machine Design,* Apr. 21, 1977, p. 260.

"Two-Stage Compensator Anticipates Cut-Off Action", by E. J. Stefanides, *Design News,* Nov. 20, 1978, pp. 74–75.

*Primary Examiner*—Edward K. Look

*Attorney, Agent, or Firm*—Phillips, Moore, Lempio & Finley

[57] ABSTRACT

It is common practice to provide the servo-system for a variable displacement pump with a "load-plus" valve to maintain pump discharge pressure above a minimum pressure level and above a load pressure in a fluid actuator connected to the pump in response to the load pressure in the actuator. Systems of this type are normally lacking in a device for ensuring that the prime mover for the pump functions at maximum efficiency. This invention is directed to a pressure and horsepower limiting valve (24) for ensuring such efficiency by modulating a load pressure signal ($P_L$) communicated to the "load-plus" valve (23).

14 Claims, 7 Drawing Figures

TORQUE AND HIGH PRESSURE LIMITING CONTROL FOR VARIABLE DISPLACEMENT PUMPS

DESCRIPTION

Technical Field

This invention relates generally to a torque and high pressure limiting control for variable displacement pumps and more particularly to modulating means for continuously modulating a fluid pressure signal originating in a fluid actuator to vary the displacement of a variable displacement pump to prevent the system from exceeding a desired horsepower range and pressure level.

Background Art

Hydraulic control circuits employed for controlling the actuation of variable displacement pumps of the type employed in construction vehicles, such as excavators, oftentimes include a so-called "load-plus" valve. The valve generally functions to maintain the discharge pressure of the pump above a minimum pressure level and also above a load pressure generated in a fluid actuator, such as a double-acting hydraulic cylinder. A valve of this type is fully disclosed in U.S. Pat. No. 4,116,587, issued on Sept. 26, 1978 to Kenneth P. Liesener and assigned to the assignee of this application.

The "load-plus" valve functions to sense a load pressure signal and to automatically actuate a swash plate of the pump in response to such signal to maintain a desired pump discharge pressure. Although this control system works quite well, it has been found lacking in the provision of means for limiting system pressures to acceptable levels and obtaining maximum performance efficiency from the prime mover for the pump. In accordance with the teachings of this invention, it has been found that the horsepower required of the prime mover can be limited and closely controlled in an infinite manner by modulating the load pressure signal directly to vary the load pressure signal communicated to the "load-plus" valve.

The present invention is directed to overcoming one or more of the problems as set forth above.

DISCLOSURE OF INVENTION

In one aspect of the present invention, a fluid circuit having a fluid actuator, a variable displacement pump including a control member, first biasing means for urging the control member towards a first displacement position, and second biasing means for urging the control member towards a second displacement position and in response to a load pressure signal received from the fluid actuator, further includes modulating means for modulating the load pressure signal in the first biasing means to vary the displacement of the pump in response to the magnitude of the signal and the position of the control member.

The improved fluid circuit, incorporating the modulating means therein, will thus provide maximum performance efficiency from the prime mover, such as an internal combustion engine, utilized to drive the pump. The control circuit is torque limiting since the modulated load pressure signal is a function of both pump discharge pressure and pump displacement, i.e., the load pressure signal thus becomes a function of pump torque. This relationship is graphically illustrated in FIG. 4 wherein curve A plots pump flow versus the load pressure signal and wherein curve B represents a horsepower curve for a particular engine.

BRIEF DESCRIPTION OF THE DRAWINGS

Other objects and advantages of this invention will become apparent from the following description and accompanying drawings wherein.

BEST MODE OF CARRYING OUT THE INVENTION

Figure 1:
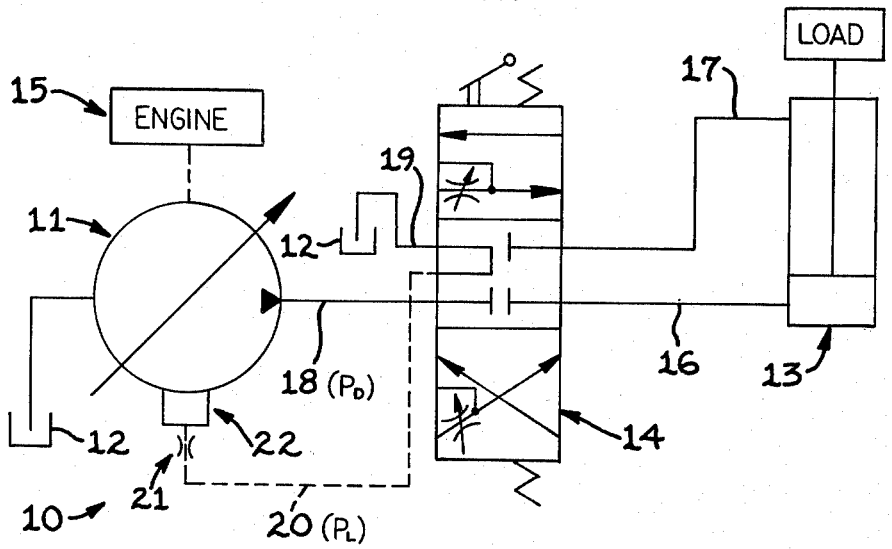
FIG. 1 schematically illustrates a fluid circuit employing a torque and high pressure limiting control for a variable displacement pump incorporating a first modulating valve embodiment of the present invention therein.

FIG. 1 illustrates a fluid circuit 10 comprising a variable displacement pump 11 adapted to communicate pressurized fluid from a source 12 to a fluid actuator 13 under the control of a directional control valve 14. A prime mover 15, such as an internal combustion engine, is adapted to drive pump 11 which may take the form of a hydraulic pump of the type shown in FIG. 2. In the illustrated fluid circuit, actuator 13 constitutes a double-acting hydraulic cylinder adapted for use on construction vehicles and the like in a conventional manner.

Upon selective actuation of directional control valve 14, head and rod ends of actuator 13 may be alternately pressurized and exhausted in a conventional manner via lines 16 and 17 and lines 18 and 19. Upon pressurization of one of the ends of actuator 13, a line 20 will communicate a load pressure signal $P_L$ through an orifice 21 and into a passage 20' within a servo-system 22 for pump 11. As described more fully hereinafter, servo-system 22 includes a so-called "load-plus" valve 23 (FIG. 2) for maintaining pump discharge pressure $P_D$ in line 18 at a specified level above load pressure signal $P_L$ in line 20 and a modulating means or horsepower limiting valve 24 for modulating load pressure signal $P_L$.

Figure 2:
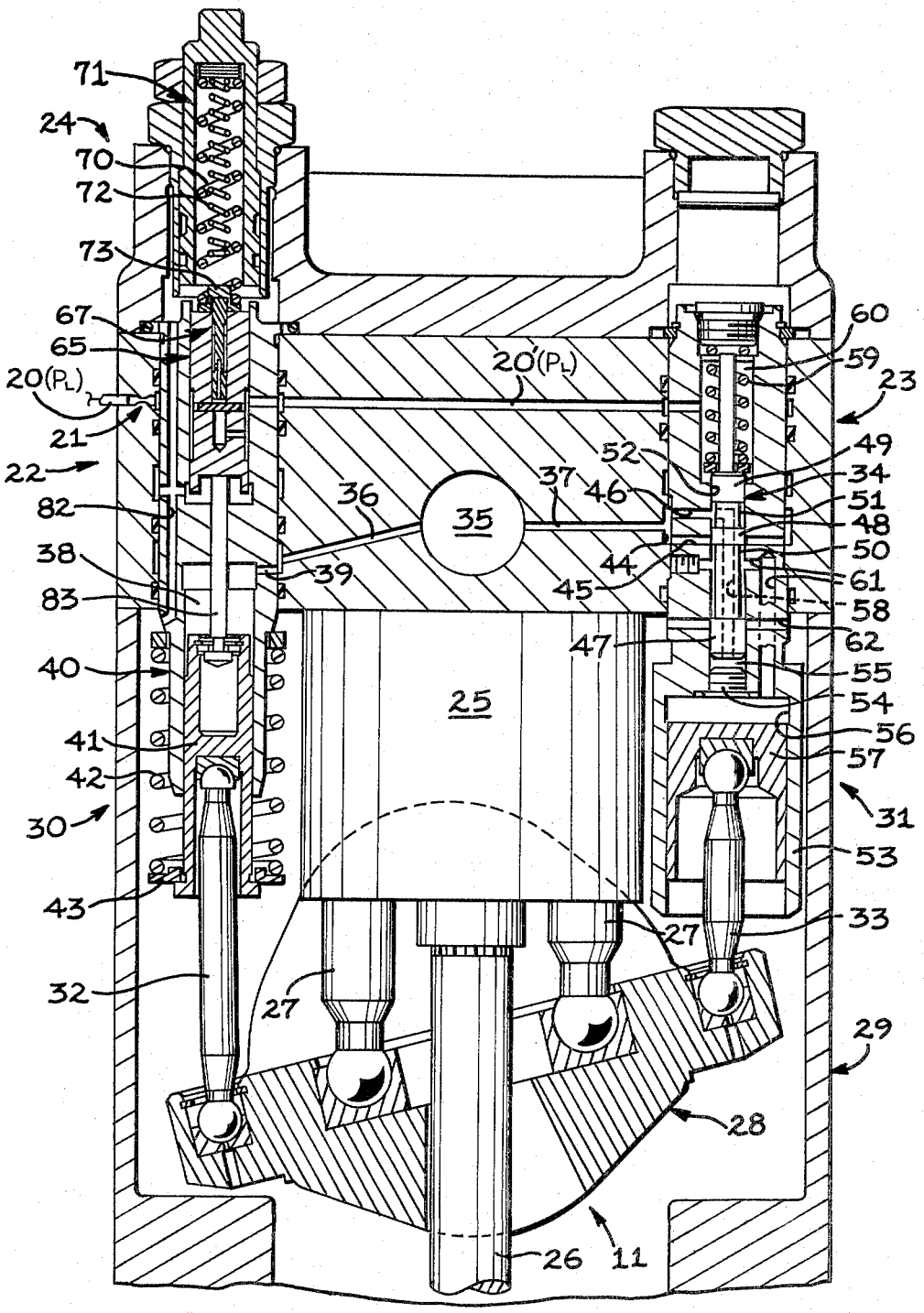
FIG. 2 is a longitudinal sectional view through the pump and control therefor.

Referring to FIG. 2, pump 11 comprises a barrel 25 adapted to be driven by an output shaft 26 of engine 15, a plurality of reciprocal pistons 27 connected to a control member or swash plate 28, and a housing 29 enclosing the pump assembly. The displacement of pump 11 is determined by the rotational orientation of swash plate 28 which has opposite sides thereof connected to first and second biasing means 30 and 31 by rods 32 and 33, respectively. In the position shown, swash plate 28 will effect maximum pump displacement, whereas horizontal orientation of the swash plate in FIG. 2 will effect zero or minimum displacement of the pump.

Second biasing means 31 may be considered to include "load-plus" valve 23, which functions substantially identically to the corresponding valve disclosed in above-referenced U.S. Pat. No. 4,116,587. In the illustrated position of a spool 34 of valve 23, pump discharge pressure $P_D$ in a main discharge passage 35 will communicate with branch passages 36 and 37, connected to first and second biasing means 30 and 31, respectively. Branch passage 36 communicates discharge pressure to an actuating chamber 38 of biasing means 30 via a port 39 formed in a tubular member 40 secured within housing 29. The force generated by fluid pressure in chamber 38 will tend to urge swash plate 28 counterclockwise in FIG. 2, towards its maximum displacement position shown, by acting on a piston 41 and rod 32. Such force is additive to the force of a compression coil spring 42 which is mounted between member 40 and a retainer 43 mounted on a lower end of piston 41.

Second branch passage 37 communicates pump discharge pressure to an annulus 44 to communicate such pressure to valve 23, via ports 45 and 46. Spool 34 of valve 23 has lands 47, 48, and 49 formed thereon to define annuluses 50 and 51 about the spool. Spool 34 is slidably mounted in a bore 52 defined in a tubular member 53 secured within housing 29 with the bore being blocked at the lower end of the spool by a plug 54.

An actuating chamber 55 is thus between reciprocal spool 34 and plug 54 and another actuating chamber 56 is defined between the plug and a piston 57 attached to rod 33. As discussed more fully hereinafter, pump discharge pressure communicated to branch passage 37 is communicated to actuating chamber 55 via port 46 and a longitudinal passage 58 formed in spool 34 to shift the spool upwardly in FIG. 2 under certain operating conditions, against the opposed biasing force of a compression coil spring 59 and the fluid pressure prevalent in an actuating chamber 60. Chamber 60 is adapted to have load pressure signal $P_L$ communicated thereto via passage 20'.

Upward shifting of spool 34, responsive to pressurization of chamber 55, will uncover port 45 at land 48 to communicate the port with annulus 50 to, in turn, pressurize chamber 56 via annulus 50 and passage 61. Drain ports 62 are also formed in member 53 for exhausting chamber 56 upon downward movement of spool 34 from its FIG. 2 position. Pressurization of chamber 56 will function to rotate swash plate 28 clockwise in FIG. 2 against the opposing biasing forces of spring 42 and the fluid pressure prevalent in chamber 38 to destroke the pump by moving the swash plate towards its minimum displacement position of operation. The function of "load-plus" valve 23 is more fully described in above-referenced U.S. Pat. No. 4,116,587.

Figure 3:
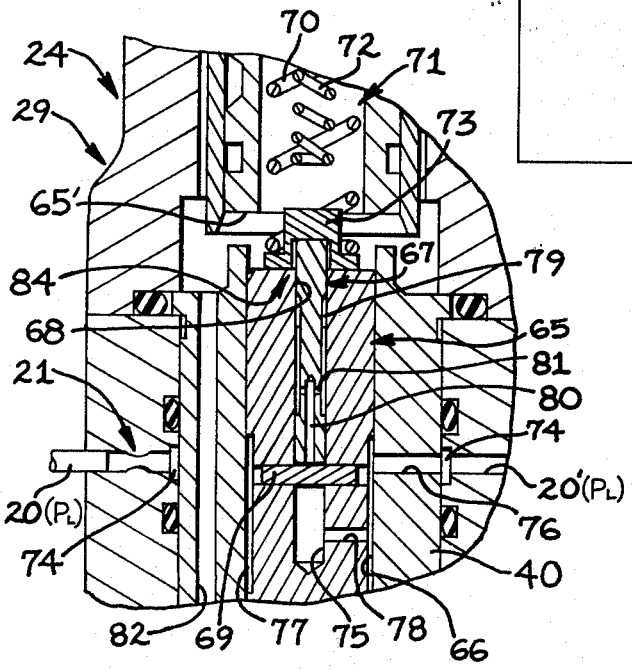
FIG. 3 is an enlarged sectional view of the modulating valve of the control.

As suggested above, this invention is directed to an improved fluid circuit 10, which further includes modulating means 24 for modulating load pressure signal $P_L$ in line 20' to continuously vary and automatically reset the displacement of pump 11. Referring to FIGS. 2 and 3, modulating means 24 includes a first spool 65 reciprocally mounted in a bore 66, defined in member 40, and a second spool 67 reciprocally mounted in a bore 68 defined in spool 65.

A stop, shown in the form of a cross pin 69, is secured within spool 65 to limit downward movement of spool 67, as shown in FIG. 3. Spool 65 is urged downwardly in FIGS. 2 and 3 by a first compression coil spring 70 of a two-stage biasing means 71 which further includes a second compression coil spring 72. A lower end of spring 70 seats on a retainer 73 which receives an upper end of spool 67 therein.

Load pressure signal $P_L$ communicated to modulating means 24 by line 20 will enter an annulus 74 and communicate to an actuating chamber 75 via a port 76 defined in member 40, an annulus 77 defined on spool 65, and a port 78 formed in the spool. As described more fully hereinafter, pressurized fluid communicated to chamber 75 will act on the lower end of piston 67 to urge it upwardly against the opposed biasing force of spring 70 to initiate modulation of load pressure signal $P_L$, as depicted at point $A_1$ in FIG. 4. In particular, upon sufficient upward movement of spool 67, load pressure signal $P_L$ will be modulated through metering slots 79 defined on spool 67, which are in communication on their upstream side with chamber 75 via a passage 80 and ports 81 and on their downstream side with a drain passage 82 upon opening thereof. This modulation of fluid will cause a fluid flow through orifice 21, creating a pressure drop thereacross to cause load pressure signal $P_L$ to become less in passage 20' than in line 20. If so desired, second spring 72 may be employed in cooperation with spring 70 to restage the modulation feature, as depicted at point $A_2$ in FIG. 4.

As briefly described above, such modulation will vary load pressure signal $P_L$ in actuating chamber 60 of "load-plus" valve 23 to control the position of swash plate 28 and, thus, the displacement of pump 11. It should be noted that rod 32 and piston 41 comprise a follow-up linkage along with a rod 83 secured to the piston. Such follow-up linkage, upon clockwise pivoting of swash plate 28 in FIG. 2, will function to move spool 65 upwardly and relative to spool 67 to modulate the opening and closing of slots 79 to drain passage 82, through a variable orifice 84 thus provided thereat.

Figure 4:
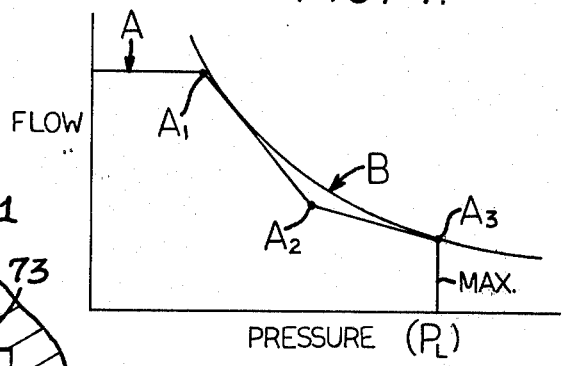
FIG. 4 graphically illustrates a curve A plotting pump flow versus a load pressure signal and a horsepower curve B.

It should be noted again in FIG. 4, wherein pump flow or displacement is plotted against load pressure signal $P_L$ on a curve A, that at point $A_1$ and in response to increase in the load pressure signal that spool 67 will have moved upwardly against the opposed biasing force of spring 70 to modulate the load pressure signal through orifice 84. As a result, pump flow or displacement will drop towards point $A_2$ whereat spring retainer 73 will engage second spring 72 to provide a stiffer resistance to the opening of the orifice whereafter the curve will tend to flatten out. FIG. 4 also illustrates a horsepower curve B which reflects the ability of the system to operate as close thereto as possible to thus conserve energy and operate the system efficiently. It is well known in the art that this typical horsepower curve is a direct function of pump displacement and load pressure.

It should be noted in FIG. 3 that when the pump strokes sufficiently to obtain a predetermined maximum system pressure (MAX. at point $A_3$ in FIG. 4) that the upper end of spool 65 will mechanically engage a stationary shoulder 65' so that no more spring force is applied to the spool by springs 70 and 72. Thus, load pressure signal $P_L$ is prevented from raising the spring load any higher and the maximum discharge pressure of the pump is limited.

Figure 5:
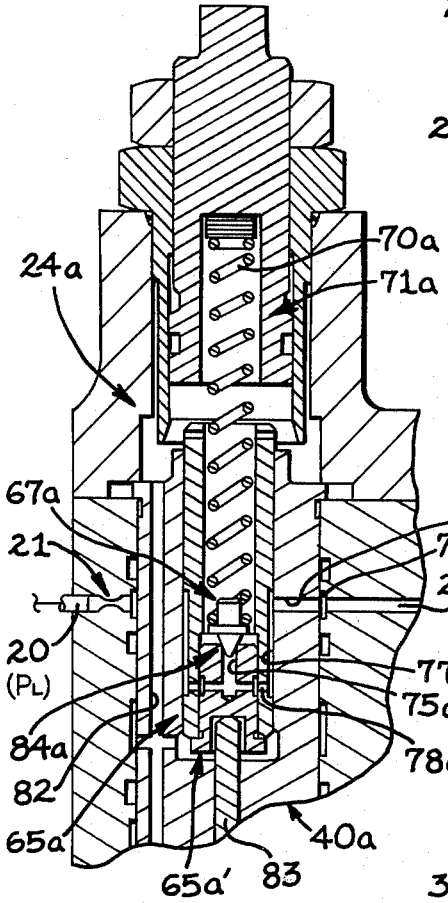
FIG. 5 is a sectional view illustrating a second modulating valve embodiment.

FIG. 5 illustrates a second horsepower limiting or modulating means embodiment **24*a* which functions similar to modulating means 24, described above. Identical numerals depict corresponding constructions and arrangements of the respective modulating means, with numerals depicting modified constructions in FIG. 5** being accompanied by an "a."

As shown in FIG. 5, load pressure signal $P_L$ communicated to modulating means **24*a* by line 20, will pass through fixed orifice 21 and communicate to passage 20'. Load pressure signal $P_L'$ will also communicate with an actuating chamber 75a, via annulus 74, port 76, an annulus 77a formed on a sleeve-like spool 65a, and ports 78a formed in the spool proper and a plug 65a' thereof. Spool 65a is reciprocally mounted in a tubular member 40a, having rod 83 of the follow-up linkage reciprocally mounted therein in a manner similar to that shown in FIG. 2. A poppet 67a is biased downwardly against a seat formed on plug 65a' and defining a variable orifice 84a thereat by a compression coil spring 70a of a biasing means 71a**.

Poppet 67a will thus control venting of load pressure signal $P_L$ from chamber 75a to drain passage 82 to thus control the operation of "load-plus" valve 23 (FIG. 2) via passage 20'. Thus, the maximum desired pressure for a given displacement setting of pump 11, which is communicated to chamber 75a, will tend to open poppet valve 67a to vent the load pressure signal to reduce the displacement of the pump. A subsequent follow-up action will be effected by rod 83 moving upwardly to close poppet valve 67a at a position which has increased the force imposed on the poppet by spring 70a. In this manner, poppet 67a and its seat on plug 65a', defining variable orifice 84a, will function substantially in the manner described in respect to modulating means 24 whereby the feedback from the pivoting of swash plate 28 will vary the force of spring 70a to infinitely adjust the load pressure setting in proportion to the position of the swash plate, so that as pump displacement reduces, system pressure will become proportionately higher and still not overcome maximum available horsepower.

Figure 6:
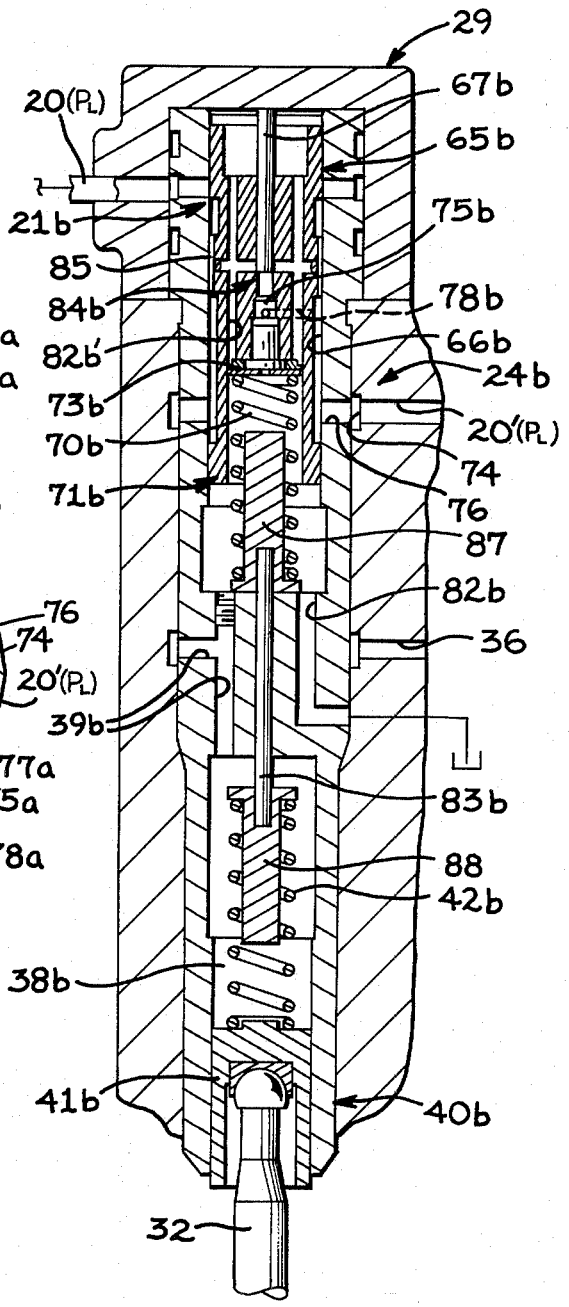
FIG. 6 is a sectional view illustrating a third modulating valve embodiment.

FIG. 6 illustrates a third horsepower limiting or modulating means embodiment 24b which functions similar to modulating means 24 and 24a with one of the differences being that modulation of load pressure signal $P_L$ is accomplished by a pair of variable orifices 21b and 84b in series rather than by a series of one fixed orifice 21 and a variable orifice 84 or 84a. Identical numerals appearing in FIG. 6 also depict corresponding constructions with numerals depicting modified constructions being accompanied by a "b" in FIG. 6.

Load pressure signal $P_L$ communicated to modulating means 24b via line 20, is adapted to communicate with passage 20' leading to "load-plus" valve 23 (FIG. 2) after undergoing a pressure drop across variable orifice 21b. The size of orifice 21b will vary depending on the reciprocal position of a spool 65b. When spool 65b moves upwardly from its position shown in FIG. 6 to open orifice 21b, load pressure signal $P_L$ is communicated to passage 20' via passages 85 defined by a plurality of flat surfaces formed on the periphery of spool 65b, an annulus 66b, ports 76, and annulus 74. Simultaneously therewith, reduced load pressure signal $P_L$ will communicate from annulus 66b to an actuating chamber 75b, defined in spool 65b, via one or more ports 78b formed in spool 65b.

A slug 67b has its upper end disposed in engagement with housing 29 and has its lower end seated on the exit end of chamber 75b to define a second variable orifice 84b thereat. A compression coil spring 70b of a biasing means 71b has its lower end engaged on a retainer 87 which engages a rod 83b of a follow-up linkage. The follow-up linkage further includes a compression coil spring 42b disposed between a retainer 88 secured to a lower end of rod 83b and a piston 41b, engaged with rod 32. It should be noted in FIG. 6 that branch passage 36, communicating with the pump discharge, further communicates with an actuating chamber 38b within the follow-up linkage via passages 39b.

In operation, spool 65b is normally urged upwardly in FIG. 6 by spring 70b to provide substantial open communication from line 20 to line 20'. Load pressure signal $P_L$ prevalent in actuating chamber 75b acts against the lower end of slug 67b to exert a downward force on spool 65b in opposition to spring 70b. As the load pressure reaches the desired maximum for a given displacement of pump 11, equalling the available horsepower generated by the engine, spool 65b will move downwardly to create a variable orifice at 84b to vent load pressure signal $P_L$ to drain via drain passages 82b' and 82b, the periphery of retainer 73b being slotted for this purpose. The resultant reduction in load pressure signal $P_L$ in passage 20' will be reflected in actuating chamber 60 of "load-plus" valve 23 (FIG. 2) to reduce the displacement of pump 11 in the manner described above. Clockwise pivoting of swash plate 28 in FIG. 2, towards its minimum displacement position, will raise rod 32 of the follow-up or feedback linkage in FIG. 6 to increase the force of spring 70b to thus increase the maximum pressure setting at this lower displacement setting for the pump.

Figure 7:
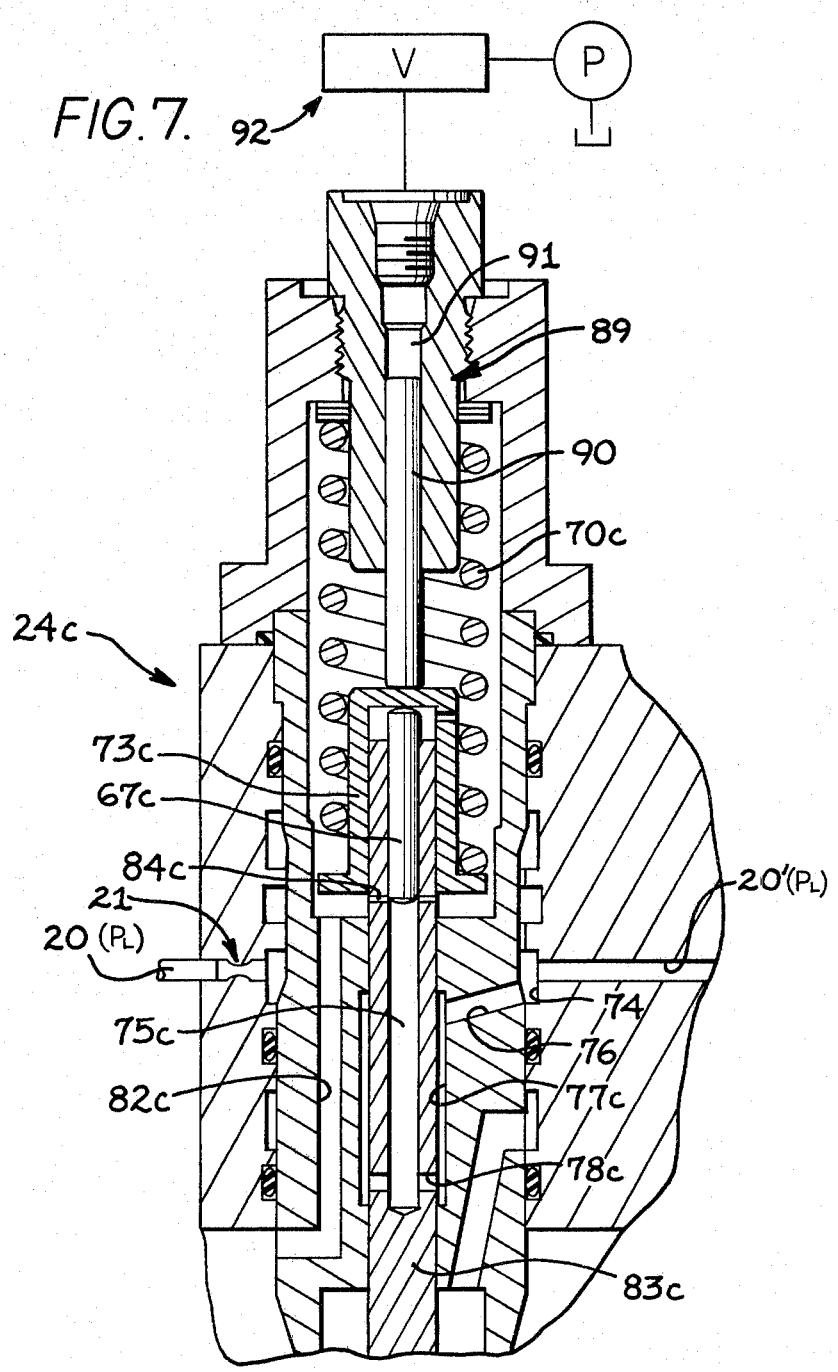
FIG. 7 is a sectional view illustrating a fourth modulating valve embodiment and an override means associated therewith.

FIG. 7 illustrates a fourth horsepower limiting or modulating means embodiment 24c wherein identical numerals depict corresponding constructions, but wherein numerals depicting modified constructions are accompanied by a "c." Modulating means 24c functions similar to above-described modulating means 24, 24a, and 24b and is further associated with a hereinafter described override means 89 for selectively overriding the automatic function of modulating means 24c. It should become obvious to those skilled in the arts relating hereto that override means 89 could be also associated with modulating means 24, 24a, and 24b with minor modification to these systems.

Load pressure signal $P_L$ communicates to modulating means 24c through line 20 and fixed orifice 21 in passage 20', connected to chamber 60 of "load-plus" valve 23 (FIG. 2). Load pressure signal $P_L$ communicates to an actuating chamber 75c, via annulus 74, port 76, an annulus 77c, and radial ports 78c formed in a rod 83c which is attached to a piston (not shown), similar to piston 41 in FIG. 2. A piston or spool 67c is reciprocally mounted in rod 83c to selectively communicate chamber 75c with a drain passage 82c, through variable orifices 84c formed in the rod. Piston 67c is biased downwardly to cover orifices 84c by a compression coil spring 70c, having its lower end seated on a cup-shaped retainer 73c. It should be further noted that an upper end of piston 67c engages retainer 73c to act against spring 70c to provide the type of follow-up and resetting function described above.

Override means 89 includes a piston 90 adapted to apply a counteracting and overriding force to rod 83c, additive to the force of spring 70c, upon the selective pressurization of an actuating chamber 91. Chamber 91 is connected to a control 92, such as the steering valve of a construction vehicle, whereby orifices 84c, when opened by upward movement of piston 67c, can be closed upon pressurization of the chamber which forces piston 90 downwardly.

Industrial Applicability

Fluid circuit 10 and the modulating means 24, 24a, 24b, and 24c, employed in servo-system 22 thereof, find particular application to hydraulic circuits for construction vehicles and the like wherein close and efficient control of fluid actuator or cylinder 13 is required.

Referring to FIGS. 1–4, "load-plus" valve 23 will function as a conventional pressure compensated flow control valve operating in a normal manner throughout the working range of pump 11 to provide a load-sensitive control of pump discharge pressure $P_D$ in line 18, relative to load pressure signal $P_L$ by continuously providing a margin between these pressures, as described in above-referenced U.S. Pat. No. 4,116,587. As load pressure signal $P_L$ reaches the desired maximum for a given displacement setting of pump 11, representative of the usable horsepower available from the engine, the load pressure signal $P_L$ in actuating chamber 75 (FIG. 3) will initiate upward movement of spool 67 against the opposed biasing force of spring 70 until metering slots 79 open to form a variable orifice at 84. At this point, the load pressure signal in chamber 75 will be modulated to decrease the fluid pressure in chamber 60 (FIG. 2) in a closely controlled manner thus causing an increase in fluid pressure in chamber 56 to rotate swash plate 28 clockwise, thus reducing the displacement of pump 11. Such rotation of swash plate 28 will move rod 32 of the follow-up linkage upwardly to close off metering slots 79 and variable orifice 84. The resultant upward movement of spool 65 will increase the force on spring 70 to that required for the particular displacement setting of the pump. This transition is depicted at point $A_1$ of curve A in FIG. 4.

This interaction within modulating means 24 will permit pump 11 to continue to operate at such a higher pressure setting without exceeding the horsepower limitations of the engine. Should the load carried by cylinder 13 demand an even greater pressure, the cycle will be repeated. It should be noted in FIG. 4 that engagement of spring retainer 73 with second spring 72 of biasing means 71 will permit a restaging of the load pressure and pump displacement, as reflected at point $A_2$ on curve A. This cyclic action of modulating means 24 and interassociated biasing means 30 and 31 will continue throughout the working pressure range of pump 11 until spool 65 contacts shoulder 65' (FIG. 3), as reflected at point $A_3$ on curve A in FIG. 4. This establishes the maximum pressure obtained and further decreasing pump displacement will not increase maximum pressure obtained.

The above-described control system thus provides an infinitely variable horsepower limiting mechanism which will closely follow horsepower curve B of the engine to provide maximum work efficiency with minimum energy consumption or specified hydraulic circuit condition of operation. Fixed orifice 21 will ensure that actuating chamber 60 of "load-plus" valve 23 can be bled-off at a sufficiently high rate to provide quick response of "load-plus" valve 23.

As described above, modified modulating means **24*a*, 24*b*, and 24*c* will function similar to modulating means 24. As further described above, override means 89 (FIG. 7**) can be readily adapted for use with any one of the modulating means to selectively override the automatic functions thereof.

Other aspects, objects, and advantages of this invention can be obtained from a study of the drawings, the disclosure, and the appended claims.

We claim:

1. In a fluid circuit (10) having a fluid actuator (13), a variable displacement pump (11) including a control member (28) movable between first and second displacement positions, first biasing means (30) for urging said control member (28) towards its first displacement position, and second biasing means (31) for urging said control member (28) towards its second displacement position in opposition to said first biasing means (30) and in response to a load pressure signal communicated thereto from said fluid actuator (13), the improvement comprising:

modulating means (24) for modulating said load pressure signal in said second biasing means (31) to vary the displacement of said pump (11) in response to the magnitude of said load pressure signal and the position of said control member (28).

2. The fluid circuit (10) of claim 1 further including means (83) for changing the setting of said modulating means (24) in response to actuation of said first biasing means (30) by said second biasing means (31) and said control member (28).

3. The fluid circuit (10) of claim 2 wherein said means (83) for changing the setting of said modulating means (24) includes a rod (83) interconnected between said first biasing means (30) and said modulating means (24).

4. The fluid circuit (10) of claim 1 further including orifice means (21) for creating a pressure drop across said modulating means (24).

5. The fluid circuit (10) of claim 4 wherein said modulating means (24) includes variable orifice means (84) for selectively venting said load pressure signal.

6. The fluid circuit (10) of claim 1 wherein said modulating means (24) includes a first spool (65), a second spool (67) reciprocally mounted in said first spool (65), biasing means (71) for biasing said second spool (67) within said first spool (65) in opposition to said load pressure signal, and variable orifice means (84) for venting said load pressure signal in response to relative movement between said first (65) and second (67) spools.

7. The fluid circuit (10) of claim 6 further including a fixed orifice (21) connected in series between said fluid actuator (13) and said variable orifice means (84).

8. The fluid circuit (10) of claim 1 wherein said modulating means **(24*a*) includes a reciprocal spool (65*a*), poppet valve means (67*a*) for opening in response to an increase in said load pressure signal, and biasing means (71*a*) for urging said poppet valve means (67*a*) to a closed position on a seat defined on said spool (65*a*)**.

9. The fluid circuit (10) of claim 8 further including a fixed orifice (21) connected in series between said fluid actuator (13) and said poppet valve means **(67*a*)**.

10. The fluid circuit (10) of claim 1 wherein said modulating means **(24*b*) includes a spool (65*b*) defining an actuating chamber (75*b*) therein, slug means (67*b*) for normally closing said chamber (75*b*) and for defining a variable orifice (84*b*) upon opening of said chamber (75*b*) in response to relative movement of said spool (65*b*), and biasing means (71*b*) for biasing said spool (65*b*) into engagement with said slug means (67*b*)**.

11. The fluid circuit (10) of claim 10 further including another variable orifice **(21*b*) interconnected between said fluid actuator (13) and the variable orifice (84*b*) defined between said slug means (67*b*) and said spool (65*b*), said another variable orifice (21*b*) being defined in part by said spool (65*b*)**.

12. The fluid circuit (10) of claim 1 further including override means (89) for selectively overriding said modulating means (24).

13. The fluid circuit (10) of claim 1 wherein flow out of said variable displacement pump (11) is a function of said load pressure signal ($P_L$), as generally depicted by curve A in FIG. 4.

14. The fluid circuit (10) of claim 13 further including prime mover means (15) for driving said variable displacement pump (11) and wherein the horsepower curve for prime mover means (15) is generally depicted by curve B in FIG. 4.

* * * * *